US008110796B2

(12) United States Patent
Vertes et al.

(10) Patent No.: US 8,110,796 B2
(45) Date of Patent: Feb. 7, 2012

(54) NANOPHOTONIC PRODUCTION, MODULATION AND SWITCHING OF IONS BY SILICON MICROCOLUMN ARRAYS

(75) Inventors: Akos Vertes, Reston, VA (US); Bennett N. Walker, Washington, DC (US)

(73) Assignee: The George Washington University, Washington, DC (US)

( * ) Notice: Subject to any disclaimer, the term of this patent is extended or adjusted under 35 U.S.C. 154(b) by 194 days.

(21) Appl. No.: 12/689,829

(22) Filed: Jan. 19, 2010

(65) Prior Publication Data

US 2010/0207021 A1 Aug. 19, 2010

Related U.S. Application Data

(60) Provisional application No. 61/145,544, filed on Jan. 17, 2009.

(51) Int. Cl.
*H01J 49/16* (2006.01)

(52) U.S. Cl. ..... 250/288; 250/281; 250/282; 250/423 P

(58) Field of Classification Search ..... 250/281–300, 250/423 P
See application file for complete search history.

(56) References Cited

U.S. PATENT DOCUMENTS

2009/0236512 A1* 9/2009 Naya et al. ..... 250/281
2009/0321626 A1* 12/2009 Vertes et al. ..... 250/282

OTHER PUBLICATIONS

J.E. Carey, Femtosecond-laser Microstructuring of Silicon for Novel Optoelectronic Devices, Thesis presented to The Division of Engineering and Applied Sciences, Harvard University, Cambridge, Massachusetts, Jul. 2004, 146 pgs.

G. Luo, Y. Chen, G. Siuzdak, and A. Vertes, Surface Modification and Laser Pulse Length Effects on Internal Energy Transfer in DIOS, The Journal of Physical Chemistry, American Chemical Society, vol. 109, Oct. 5, 2005, pp. 24450-24456.

T.R. Northen, O. Yanes, M.T. Northen, D. Marrinucci, W. Uritboonthai, J. Apon, S.L. Golledge, A. Nordstrom, and G. Siuzdak, Clathrate nanostructures for mass spectrometry, Nature, Letters, vol. 449, Oct. 25, 2007, Nature Publishing Group, pp. 1033-1037, with Supplementary Information, pp. 1-24, www.nature.com/nature.

C.H. Crouch, J.E. Carey, J.M. Warrender, M.J. Aziz, E. Mazur, and F.Y. Genin, Comparison of structure and properties of femtosecond and nanoscecond laser-structured silicon, Applied Physics Letters, vol. 84, No. 11, Mar. 15, 2004, American Institute of Physics, pp. 1850-1852.

(Continued)

*Primary Examiner* — Jack Berman
(74) *Attorney, Agent, or Firm* — Blank Rome LLP

(57) ABSTRACT

The production and use of silicon microcolumn arrays that harvest light from a laser pulse to produce ions are described. The systems of the present invention seem to behave like a quasi-periodic antenna array with ion yields that show profound dependence on the plane of laser light polarization and the angle of incidence. By providing photonic ion sources, this enables enhanced control of ion production on a micro/nano scale and direct integration with miniaturized analytical devices.

22 Claims, 8 Drawing Sheets

OTHER PUBLICATIONS

P. Bhatnagar, S.S. Mark, I. Kim, H. Chen, B. Schmidt, M. Lipson, and C.A. Batt, Dendrimer-Scaffold-Based Electron-Beam Patterning of Biomolecules, Advanced Materials, Copyright Wiley-VCH 2006, pp. 315-319, www.advmat.de.

J. Wei, J.M. Buriak, and G. Siuzdak, Desorption-ionization mass spectrometry on porous silicon, Letters to Nature, Macmillan Magazines Ltd., Nature, vol. 399, May 20, 1999, pp. 243-246, www.nature.com.

T.H. Her, R.J. Finlay, C. Wu, and E. Mazur, Femtosecond laser-induced formation of spikes on silicon, Applied Physics A Materials Science & Processing, copyright Springer-Verlag 2000, pp. 383-385, Published Online Mar. 8, 2000.

S.A. Akhmanov, V.I. Emelyanov, N. I. Koroteev, and V.N. Semingov, Interaction of powerful laser radiation with the surfaces of semiconductors and metals: nonlinear optical effects and nonlinear optical diagnostics, American Institute of Physics, Soy. Phys. Usp. Dec. 28, 1985, pp. 1084-1124.

V. Zorba, L. Persano, D. Pisignano, A. Athanassiou, E. Stratakis, R. Cingolani, P. Tzanetakis, and C. Fotakis, Making silicon hydrophobic: wettability control by two-lengthscale simultaneous patterning with femtosecond laser irradiation, Nanotechnology, Institute of Physics Publishing, Jun. 7, 2006, pp. 3234-3238, stacks.iop.org/nano/17/3234.

B.N. Walker, J.A. Stolee, D.L. Pickel, S.T. Retterer, and A. Vertes, Tailored Silicon Nanopost Arrays for Resonant Nanophotonic Ion Production, The Journal of Physical Chemistry, American Chemical Society, vol. 114, No. 11, Mar. 25, 2010, pp. 4835-4840, pubs.acs.org/jpcc.

A. Westman, T. Huth-Fehre, P. Demirev, J. Bielawski, N. Medina, and B. U.R. Sundqvist, Matrix-assisted Laser Desportion/Ionization: Dependence of the Ion Yield on the Laser Beam Incidence Angle, Rapid Communications in Mass Spectrometry, vol. 8, 1994, pp. 388-393, John Wiley & Sons, Ltd.

T.H. Her, R.J. Finlay, C. Wu, S. Deliwala, and E. Mazur, Microstructuring of silicon with femtosecond laser pulses, American Institute of Physics, Applied Physics Letters, vol. 73, No. 12, Sep. 21, 1998, pp. 1673 -1675.

B. Schmidt, V. Almeida, C. Manolatou, S. Preble, and M. Lipson, Nanocavity in a silicon waveguide for ultrasensitive nanoparticle detection, American Institute of Physics, Applied Physics Letters. vol. 85, No. 21, Nov. 22, 2004, pp. 4854-4856.

A. J. Pedraza, Y.F. Fuan, J.D. Fowlkes, and D.A. Smith, Nanostructures produced by ultraviolet laser irradiation of silicon. I. Rippled structures. American Vacuum Society, J. Vac. Sci. Technol. B, vol. 22, No. 6, Nov./Dec. 2004, pp. 2823-2835.

C. Girard, Near fields in nanostructures, Institute of Physics Publishing, Reports on Progress in Physics, 68, 2005, pp. 1883-1933, IOP Publishing Ltd.

Y. Chen and A. Vertes, Adjustable Fragmentation in Laser Desorption/Ionization from Laser-Induced Silicon Microcolumn Arrays, Analytical Chemistry, vol. 78, No. 16, Aug. 15, 2006, pp. 5835-5844.

S. Coyle, M.C. Netti, J.J. Baumberg, M.A. Ghanem, P.R. Birkin, P.N. Bartlett, and D.M. Whittaker, Confined Plasmons in Metallic Nanocavities, The American Physical Society, Physical Review Letters, vol. 87, No. 17, Oct. 22, 2001, pp. 176801-1-176801-4.

T.H. Taminiau, F.D. Stefani, F.B. Segerink, and N. F. Van Hulst, Optical antennas direct single-molecule emission, Nature photonics, Letters, vol. 2, Apr. 2008, Nature Publishing Group, Published online Mar. 16, 2008, www.nature.com/naturephotonics, pp. 234-237.

Y. Chen and A. Vertes, Pumping Rate and Surface Morphology Dependence of Ionization Processes in Matrix-Assisted Laser Desorption Ionization, American Chemical Society, The Journal of Physical Chemistry, vol. 107, 2003, pp. 9754-9761.

A.J. Pedraza, J.D. Fowlkes, Y.F. Guan, Surface nanostructuring of silicon, Applied Physics A, Materials Science & Processing, vol. 77, 2003, pp. 277-284.

A. P. Quist, T. Huth-Fehre, and B. U.R. Sundqvist, Total Yield Measurements in matrix-assisted Laser Desorption Using a Quartz Crystal Microbalance, Division of Ion Physics, Department of Radiation Sciences, Uppsala University, Revised Dec. 24, 1993, pp. 149-154 of Rapid Communications in Mass Spectrometry, vol. 8.

* cited by examiner

NANOPHOTONIC PRODUCTION, MODULATION AND SWITCHING OF IONS BY SILICON MICROCOLUMN ARRAYS

CROSS-REFERENCE TO RELATED APPLICATIONS

This application claims priority to U.S. Provisional Patent Application 61/145,544, filed Jan. 17, 2009, the disclosure of which is hereby incorporated by reference herein.

STATEMENT REGARDING FEDERALLY SPONSORED RESEARCH

The subject matter of this application was made with support from the United States Government under Grant No. DEFG02-01ER15129 from the Department of Energy. The United States Government retain certain rights in the invention.

BACKGROUND OF THE INVENTION

1. Field of the Invention

The field of the invention is mass spectrometry (MS), and more specifically a process and apparatus for using polarized laser light to provide improved control of ion yields during desorption of a sample.

2. Description of the Related Art

Laser desorption ionization mass spectrometry (LDI-MS) of organic molecules and biomolecules provides chemical analysis with great selectivity and sensitivity. Presently available methods generally rely on the interaction of laser radiation with a matrix material or with nanoporous substrates for the production of ions. Examples of these techniques include matrix-assisted laser desorption ionization (MALDI), desorption ionization on silicon (DIOS), and nanostructure-initiator mass spectrometry (NIMS). From laser shot to laser shot, these methods exhibit spontaneous fluctuations in ion yield that can only be controlled by adjusting the fluence delivered to the surface.

Highly confined electromagnetic fields play an important role in the interaction of laser radiation with nanostructures. Near-field optics show great potential in manipulating light on a sub-micron or even on the molecular scale. Nanophotonics takes advantage of structures that exhibit features commensurate with the wavelength of the radiation. Among others it has been utilized for nanoparticle detection, for the patterning of biomolecules and for creating materials with unique optical properties. The latter include laser-induced silicon microcolumn arrays (LISMAs), produced by ultrafast laser processing of silicon surfaces, and are known to have uniformly high absorptance in the 0.2-2.4 μm wavelength range as well as superhydrophobic properties. At sufficiently high laser intensities, the molecules adsorbed on these nanostructures undergo desorption, ionization and eventually exhibit unimolecular decomposition. The resulting ion fragmentation patterns can be used for structure elucidation in mass spectrometry. Manipulation of ion production from biomolecules with photonic structures (i.e., photonic ion sources) based on the laser light-nanostructure interaction, however, has not previously been demonstrated.

Photonic ion sources based on array-type nanostructures, such as laser induced silicon microcolumn arrays (LISMA), can serve as platforms for LDI-MS for detection of various organic and biomolecules. Compared to conventional LDI-MS ion sources, e.g., MALDI, DIOS and NIMS, nanophotonic ion sources couple the laser energy to the nanostructures via a fundamentally different mechanism due to the quasiperiodic or periodic and oriented nature of the arrays. The inventors have demonstrated for the first time that nanophotonic ion sources show a dramatic disparity in the efficiency of ion production depending on the polarization angle and the angle of incidence of the laser. When the electric field of the radiation has a component that is parallel to the column axes (p-polarized beam) the desorption and ionization processes are efficient, whereas in case they are perpendicular (s-polarized waves) minimal or no ion production is observed. In addition, LISMA structures also exhibit a strong directionality in ion production. The ion yield as a function of the incidence angle of an unpolarized laser beam decreases and ultimately vanishes as the incidence angle approaches 0°. This strong directionality in ion production is a unique feature of these nanostructures.

Photonic ion sources, such as LISMA, rely on the quasiperiodic or periodic and oriented nature of the nanostructures with dimensions commensurate with the wavelength of the laser light. These photonic ion sources rely on unique nanophotonic interactions (e.g., near-field, confinement, and interference effects) between the electromagnetic radiation and the nanostructure on one hand, and the interaction of both with the surface-deposited sample molecules, on the other. These devices exhibit a control of ion production by varying laser radiation properties other than simple pulse energy, mainly through changes in the angle of incidence and the plane of polarization of the laser radiation. Structural parameters of the photonic ion sources (i.e., column diameter, height and periodicity) enable further control of coupling the laser energy on a micro and nano scale. Combination of nanophotonic ion sources with miniaturized mass analyzers can lead to the development of integrated miniaturized mass spectrometers and analytical sensors.

SUMMARY OF THE INVENTION

It is an object of the present invention to provide mass spectrometry system for controlling the fragmentation and ion production from a sample. The systems of the present invention contain a pulsed laser source, a polarizer capable of rotating the angle of plane polarized radiation from the laser source between and beyond s-polarized radiation and p-polarized radiation, an array for receiving the sample, the array being made from a semiconductor material and having quasi-periodic columnar structures, and a mass spectrometer for detecting ions formed from the sample. In operation of the systems of the present invention, when the radiation from the pulsed laser source is rotated so that when the angle of the plane polarization of the laser source approaches the angle of p-polarized radiation, the ion production and, at sufficiently high laser fluences, the fragmentation from the sample is increased, and when the angle of the plane polarization of the laser source approaches the angle of s-polarized radiation, the fragmentation diminishes and eventually ceases, and ion production from the sample is decreased.

It is a further object of the present invention to provide methods for controlling the fragmentation and ion production from a sample during mass spectrometry analysis. The steps of the methods of the present invention include: providing a sample, providing a pulsed laser source, providing a polarizer capable of rotating the angle of plane polarized radiation from the laser source between s-polarized radiation and p-polarized radiation, contacting the sample with an array made from a semiconductor material and having quasi-periodic columnar structures, and providing a mass spectrometer for detecting ions formed from the sample. In performing the methods of the present invention, when the radiation from the pulsed laser source is rotated so that when the angle of the plane polarization of the laser source approaches the angle of p-polarized radiation, the ion production and, at sufficiently high laser fluences, the fragmentation detected by the mass spectrometer is increased, and when the angle of the plane polarization of the laser source approaches the angle of s-polarized radiation, the fragmentation diminishes and eventually ceases, and ion production detected by the mass spectrometer is decreased.

The systems and methods of the present invention provide novel control over fragmentation and ion production during sample desorption for mass spectrometry. Fragmentation and ion production may be increased or decreased by rotating the plane of the polarized desorption laser pulses, allowing for control over these phenomena without the need to laser attenuation or system adjustments.

DETAILED DESCRIPTION OF THE INVENTION

Figure 1:
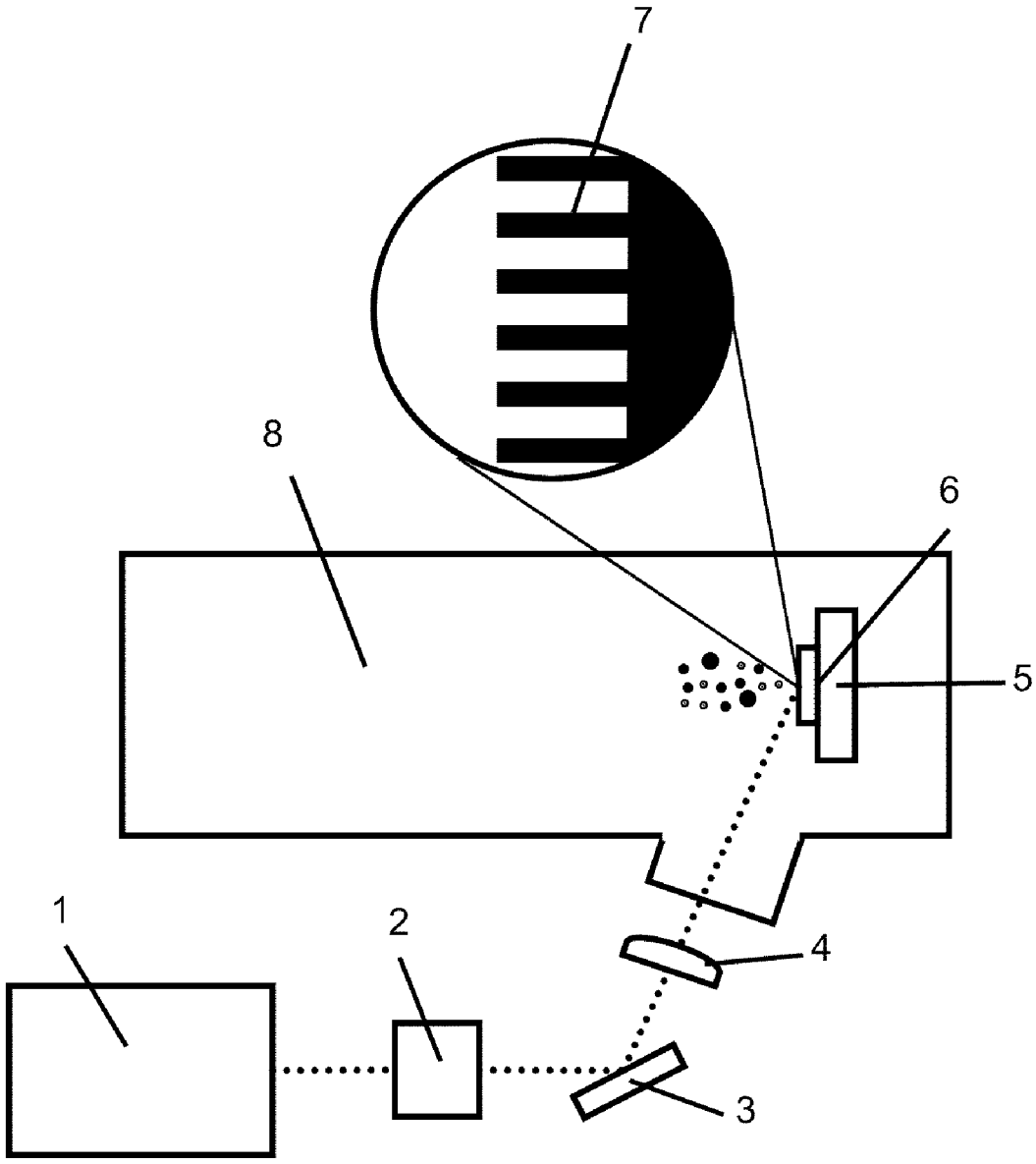
FIG. 1: Shows a schematic view of an embodiment of a laser desorption mass spectrometry system of the present invention.

The following abbreviations may be used throughout this specification: LDI-MS—Laser Desorption Ionization Mass Spectrometry; MALDI—Matrix-Assisted Laser Desorption Ionization; DIOS—Desorption Ionization on Silicon; NIMS—Nanostructure Initiator Mass Spectrometry; LISMA—Laser-Induced Silicon Microcolumn Array.

The production and use of microcolumn and nanocolumn arrays that harvest light from a laser pulse to produce ions is described herein. The systems described seem to behave like a quasi-periodic antenna arrays with ion yields that show dependence on the plane of laser light polarization and the angle of incidence. These photonic ion sources enable an enhanced control of ion production on a micro/nano scale and its direct integration with miniaturized analytical devices.

In a preferred embodiment of the invention, there is provided a laser-induced silicon microcolumn array (LISMA) for the detection of a sample by mass spectrometry. Examples of LISMAs which may be used in conjunction with the present invention can be found in U.S. Patent Application Publication 2009/0321626, which is hereby incorporated by reference herein. The arrays may be adapted to be in cooperative association with a polarized desorption laser beam having a specific wavelength. The microcolumn array is typically a silicon wafer made from low resistivity p-type or n-type silicon having a plurality of about 100 $\mu m^2$ to 1 $cm^2$ processed areas that are covered with quasi-periodic columnar structures. The structures are generally aligned perpendicular to the silicon wafer but they may also be aligned at other well defined angles. The structures generally have dimensions according to the desorption laser used in the desorption of sample for mass spectrometry analysis. For example, the columnar structures may have a height of about 1 to 5 times the wavelength of the desorption laser, a diameter equal to about one wavelength of the desorption laser, and a lateral periodicity of about 1.5 times the wavelength of the desorption. In certain embodiments, the columnar structures have a height of 2 times the wavelength of the desorption laser.

The LISMAs of the present invention may be produced by processing a polished silicon wafer by exposing it to multiple ultrashort ultraviolet, visible or infrared laser pulses of about 100 picoseconds to about 50 femtoseconds duration in different processing environments, such as liquid water, sulfur hexafluoride, glycerol and aqueous solutions such as bases or acids. Particular examples of aqueous solutions that may be used include sodium hydroxide and acetic acid solutions. The use of different processing environments allows for the production of LISMAs with different chemical residues in the columnar structures that may facilitate ionization and/or desorption. As a non-limiting example, use of sodium hydroxide processing environment provides a LISMA with sodium hydroxide residues and/or surface hydroxyl groups on the columnar structures that enhances ion production and desorption.

The laser used for processing the arrays of the present invention may be the same or different from the laser used during desorption of samples. It will be apparent to those of skill in the art that various types of lasers can be used in producing the arrays and for sample desorption, including gas lasers such as nitrogen and carbon dioxide lasers, and solid-state lasers, including lasers with solid-state crystals such as yttrium orthovanadate (YVO4), yttrium lithium fluoride (YLF) and yttrium aluminum garnet (YAG) and with dopants such as neodymium, ytterbium, holmium, thulium, and erbium. In certain embodiments of the present invention, the laser used for processing the arrays is a mode-locked Nd:YAG laser and the laser used for desorption of the sample is a nitrogen laser.

In other embodiments of the invention, the array may be made from other semiconducting materials, such as germanium, gallium arsenide and the like.

In certain embodiments of the present invention, the arrays used may have columnar structures with a height of from about 200 nm to about 1500 nm, preferably about 600 nm, a diameter of from about 200 nm to about 400 nm, preferably 300 nm, and a lateral periodicity of from about 450 nm to about 550 nm, preferably 500 nm. It is further contemplated that the arrays used may have columnar structures with other dimensions consistent with nanocolumn arrays and microcolumn arrays as are known in the art.

In other embodiments of the present invention, there are provided laser desorption ionization mass spectrometry systems having i) a micro- or nano-array for holding a sample; ii) a pulsed laser for emitting energy at the sample for desorption and ionization; iii) focusing optics based on lenses, mirrors or sharpened optical fiber; iv) a polarizer for polarizing the laser radiation, and v) a mass spectrometer for analyzing and detecting the produced ions. In other embodiments, the systems of the present invention also include vi) a positioning apparatus and software for lateral positioning of multiple points on the laser-induced silicon microarray.

Irradiation from a polarized pulsed laser is focused onto a photonic ion source comprised of an array of columnar nano- and micro-structures after analyte is deposited onto its surface. Due to its structure, energy coupling between the columns produces molecular and at sufficiently high laser fluences fragment ions that can be detected in a time-of-flight mass spectrometer. These photonic ion structures can enhance the control of ion production on a micro/nano scale by adjusting the angle of incidence and the plane of polarization of the desorption laser.

A preferred embodiment of a system of the present invention is shown in FIG. 1. The nanophotonic ion source shown in the figure has such an arrangement that the light from a pulsed laser source 1 is polarized by a Glan-Taylor calcite polarizer 2 and focused onto an ionization platform 5 by focusing optics containing mirrors 3 and a focusing lens 4. The ionization platform 5 is comprised of a photonic ion source 6 that has been fabricated or processed to develop an array of columnar micro- or nano-structures 7. The ionization platform 5 is integrated with a time-of-flight mass spectrometer 8 where ions are separated and detected.

In other embodiments of the present invention, the polarizer may be any type of polarizer which allows for plane polarization of light from the pulsed laser source, as will be recognized by one of skill in the art.

The systems of the present invention may be used to provide for enhanced control over ion production and sample molecule fragmentation by adjusting the polarization of the radiation of the desorption laser. In preferred embodiments of the invention, molecule fragmentation and ion production is increased while the plane of polarization of the laser radiation is rotated from s-polarized to p-polarized. Without wishing to be bound by theory, it appears that p-polarized laser light is significantly more efficiently absorbed by the columnar structures than s-polarized laser light. This appears to result in large temperature differences during the two types of laser pulses, which translate into differences in desorption efficiency and ion yield.

In other embodiments, the present invention encompasses methods for increasing molecular fragmentation and ion production by adjusting the polarization of the radiation of the desorption laser. As is described above, in certain embodiments of the invention, the molecular fragmentation and ion production increases as the polarization of the laser radiation is rotated from s-polarized to p-polarized. Once a sample to be analyzed is applied to an array of the present invention, fragmentation and ion production can be increased by rotating the plane of the laser radiation towards p-polarization and decreased by rotating the plane of the laser radiation towards s-polarization. This method allows for control over fragmentation and ionization without the need to attenuate the desorption laser. It also allows for changes to be made in the fragmentation and ion production of a sample within a single system setup.

As a non-limiting example, once a sample is applied to an array, the array may initially be irradiated with s-polarized light, causing little to no ionization and fragmentation. The plane of the radiation may then be gradually rotated towards p-polarization as is desired by the operator. As the plane of polarization is rotated, the fragmentation of the sample and ion production will increase, allowing for the detection of an array of fragments and molecular ions by the mass spectrometer. For instance, the plane of the radiation may be rotated towards p-polarization in a manner so that larger fragments, such as the molecular ion peak, are first detected, followed by increased fragmentation and detection of smaller fragments. Using the methods of the present invention, a broad spectrum of fragments and ions can be produced and detected from a single system setup.

It is also contemplated that certain arrays may show increased fragmentation and ion production at plane polarizations other than light with a plane of polarization perpendicular to the wafer. As will be apparent to one of skill in the art, it is possible that arrays having columnar structures that are not perpendicular to the wafer may show peak fragmentation and ion production at polarization angles coincident with the angle of the columnar structure or at other angles. One of skill in the art will know how to determine the polarization angle for these arrays and the plane polarization may simply be rotated to determine the effect on fragmentation and ion production.

The systems and methods of the present invention may be used in the mass spectral analysis of various samples, including pharmaceuticals, dyes, explosives or explosive residues, narcotics, polymers, tissue samples, individual cells, small cell populations, microorganisms (bacteria, viruses and fungi), biomolecules, chemical warfare agents and their signatures, peptides, metabolites, lipids, oligosaccharides, proteins and other biomolecules, synthetic organics, drugs, and toxic chemicals.

The systems and methods of the present invention provide ultra low limits of detection and a wide dynamic range. In certain embodiments of the invention, the limits of detection may be about 1 attomole or less. In other embodiments of the invention, the limits of detection may be 0.5 attomole or less, 2 attomole or less, 3 attomole or less, 4 attomole or less, 5 attomole or less, 10 attomole or less, 20 attomole or less, or 100 attomole or less. In certain embodiments of the invention, the dynamic range may be 4 magnitude or more. In other embodiments of the invention, the dynamic range may be 2 magnitude or more, 3 magnitude or more, 5 magnitude or more, 6 magniture or more, or 10 magnitude or more. As will be recognized by one of skill in the art, the limits of detection and dynamic range will vary depending on the sample analyzed.

In certain embodiments of the invention, the systems may also include a photonically modulated ion source that exhibits a control of ion production by varying laser radiation properties other than simple pulse energy, mainly through changes in angle of incidence and plane of polarization of the laser radiation.

In other embodiments of the invention, the systems and methods provide for enhanced energy coupling on a micro/nano scale that can lead to the development of miniaturized mass spectrometry devices and for combination with miniaturized or nano-scale separation devices.

It is further contemplated that the methods and systems of the present invention may also be used for the production of ions for applications besides mass spectrometry. Such applications include the production of ions for use in encryption technology, sensor technologies and energy harvesting.

Non-limiting examples of the systems and methods of the present invention are given below. It should be apparent to one of skill in the art that there are variations not specifically set forth herein that would fall within the scope and spirit of the invention as claimed below.

EXAMPLE

Background

Highly confined electromagnetic fields play an important role in the interaction of laser radiation with nanostructures [1]. Near-field optics show great potential in manipulating light on a sub-micron or even on the molecular scale.[2] Nanophotonics takes advantage of structures that exhibit features commensurate with the wavelength of the radiation. Among others it has been utilized for nanoparticle detection,[3] for the patterning of biomolecules[4] and for creating materials with unique optical properties.[5] The latter include laser-induced silicon microcolumn arrays (LISMAs), produced by ultrafast laser processing of silicon surfaces,[6] and are known to have uniformly high absorptance in the 0.2-2.4 μm wavelength range[7] as well as superhydrophobic properties.[8] At sufficiently high laser intensities, the molecules adsorbed on these nanostructures undergo desorption, ionization and eventually exhibit unimolecular decomposition. The resulting ion fragmentation patterns can be used for structure elucidation in mass spectrometry.[9] Manipulation of ion production from biomolecules with photonic structures (i.e., photonic ion sources) based on the laser light-nanostructure interaction, however, has not previously been demonstrated.

Here, a dramatic disparity in the efficiency of ion production from LISMAs that depend on the polarization of the incident laser is shown. When the electric field of the radiation has a component that is parallel to the column axes (p-polarized beam) the desorption and ionization processes are efficient, whereas in case they are perpendicular (s-polarized waves) minimal ion production is observed. These results are also corroborated by studying the ion yield as a function of the incidence angle of an unpolarized laser beam. This strong directionality in ion production is a unique feature of these nanostructures.

Creation of Arrays and Mass Spectrometry Analysis

Figure 2:
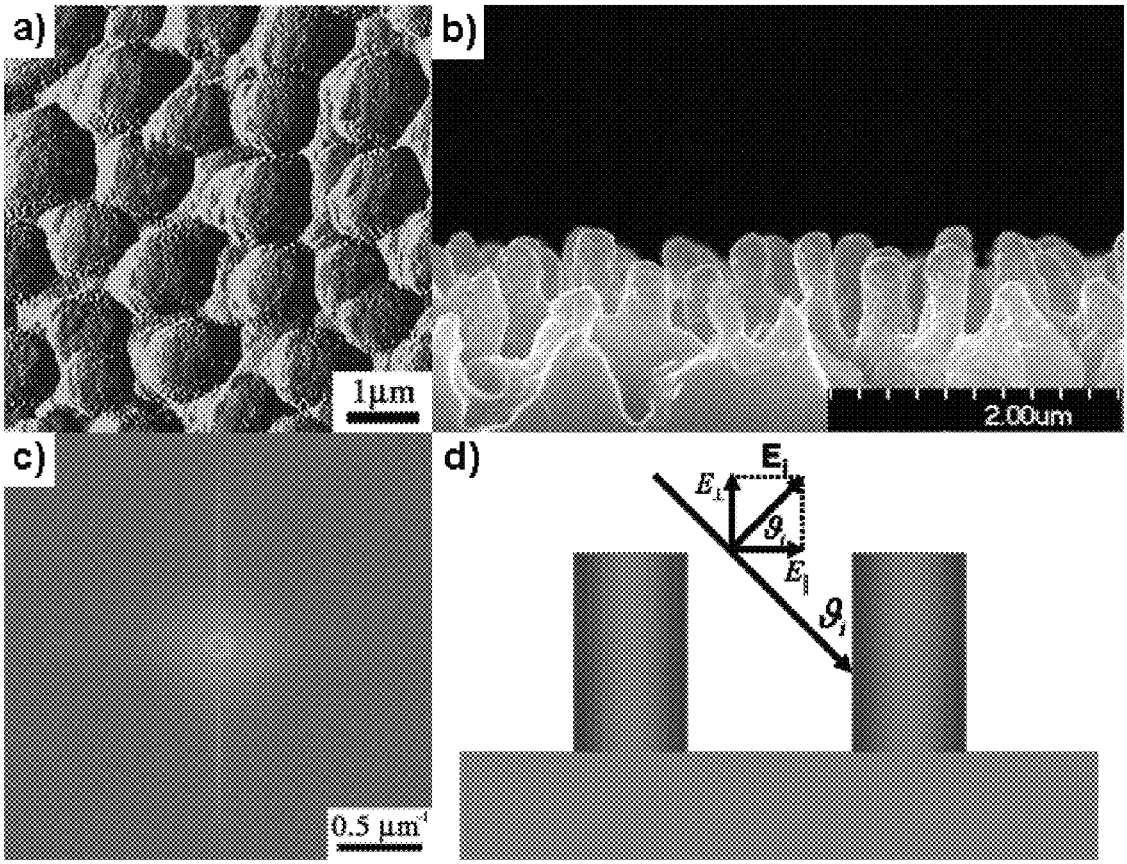
FIG. 2: a) A top view by AFM which reveals the quasi-periodic arrangement of the microcolumns in LISMA; b) a cross sectional view by SEM which shows an average column height and diameter of ~600 nm and ~300 nm, respectively, with ~200 nm troughs between the columns; c) a two-dimensional FFT of a top view image by SEM which reveals the ~500 nm mean periodicity of LISMA structures; and d) a schematic of the incident laser beam microcolumn interaction.

LISMAs were created by exposing low resistivity p-type silicon wafers to 600 pulses from a mode-locked frequency-tripled Nd:YAG laser (0.13 $\mu Jcm^{-2}$) in an aqueous environment. The resulting ~1 $mm^2$ processed areas were covered with quasi-periodic columnar structures that were, on the average, aligned perpendicular to the silicon wafer. FIGS. 2*a* and 2*b* show a top view using atomic force microscopy (AFM), and a cross sectional view using scanning electron microscopy (SEM), respectively. The average periodicities of the resulting arrays were determined by taking the 2D Fourier transform of the SEM image (FIG. 2*c*). A weak ring indicates some non-directional local periodicity, with a typical spacing of about 500 nm. The schematic in FIG. 2*d* shows the relationship between the laser beam and the microcolunm with the electric field vector for a p-polarized ray, $E_i$, its components parallel, its components parallel, $E_{\parallel}=E_i \cos \theta_i$, and perpendicular, $E_{\perp}=E_i \sin \theta_i$, to the substrate, and with the angle of incidence, $\theta_i$.

After cleaning and drying, these structures were used as substrates for laser desorption ionization experiments. Typically, 1 μL of sample solution was directly deposited on the LISMA and inserted into a time-of-flight (TOF) mass spectrometer (MS). Similar to matrix-assisted laser desorption ionization (MALDI), pulses from a nitrogen laser were used to produce the ions. Experiments were conducted to investigate the ion yields for various organic and biomolecules as a function of substrate orientation with respect to the beam direction for unpolarized, and their dependence on the angle between the plane of incidence and the electric field vector for polarized laser beams.

Figure 3:
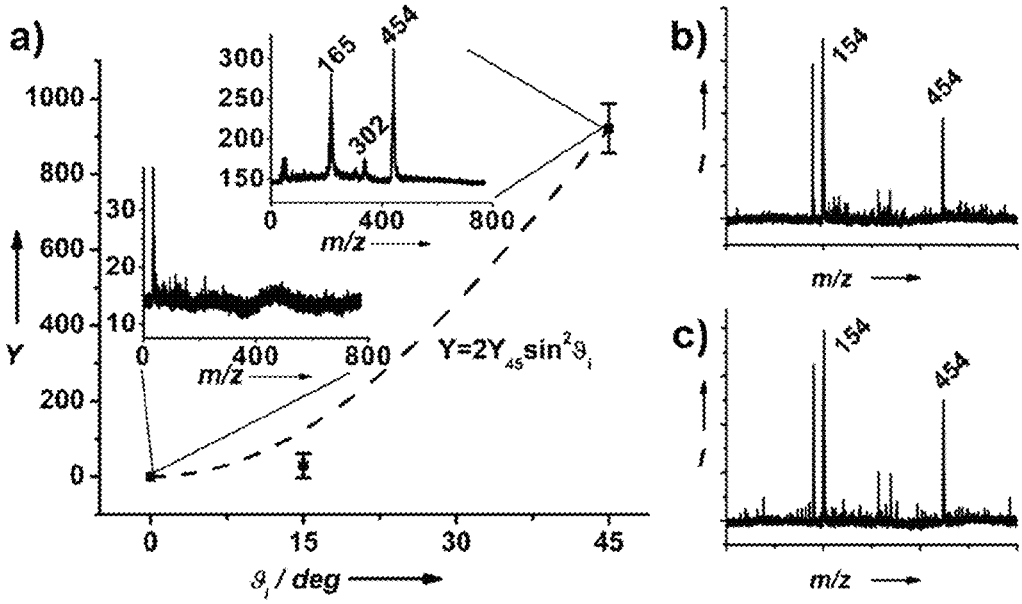
FIG. 3: a) A plot of ion yields for verapamil desorbed from a LISMA which drop dramatically between incidence angles of 45° and 15° and vanish at 0°. Insets show the mass spectra for 45° and 0°. MALDI experiments show no change in the spectra for incidence angles of b) 0° and c) 45°. A simple model prediction, analogous to Eq. (1), is shown by the dashed line.
Figure 4:
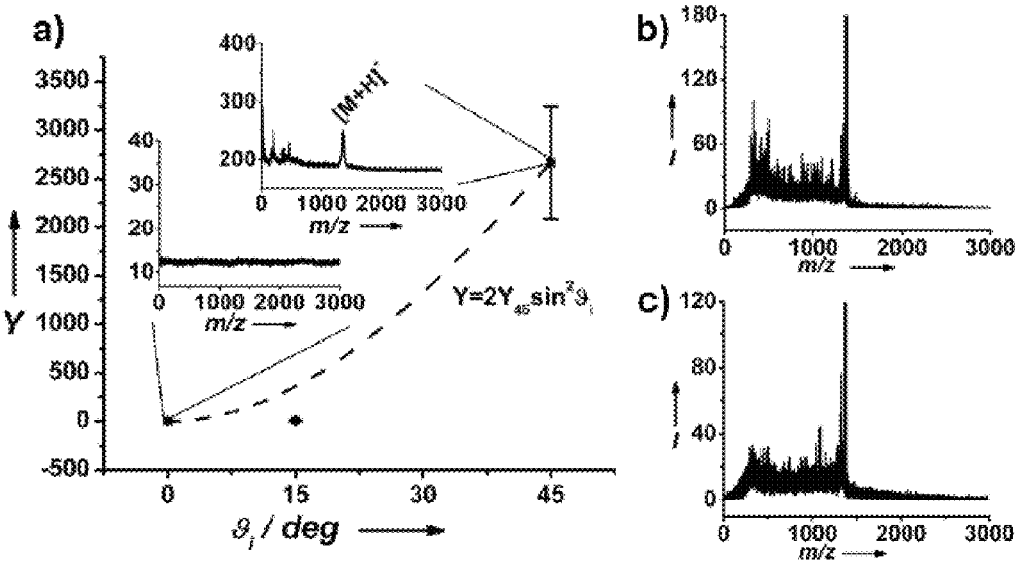
FIG. 4: a) A plot of ion yields for substance P desorbed from LISMA between incidence angles 0° and 45°. Insets show the LISMA mass spectra for 0° and 45°. MALDI experiments with DHB matrix show no change in the spectra for incidence angles b) 0° and c) 45°. A simple model prediction, analogous to Eq. (1), is shown by the dashed line.

For MALDI the incidence angle of the desorption laser beam with respect to the sample had no effect on the analyte ion yield[10] and only moderate influence on the total desorption[11] yields. For the polycrystalline samples produced by the common dried droplet sample preparation technique in MALDI, this observation was rationalized in terms of the random orientation of the matrix crystals. On LISMA substrates, however, the average column orientation is perpendicular to the wafer. Moreover, the mean periodicity of the LISMA structure is commensurate with the wavelength of the laser light. Thus, directionality of the interaction between the laser beam and the LISMA structure was explored by altering the sample orientation in the mass spectrometer. The LISMA substrates were mounted on three different facets of a cylindrical sample probe machined to produce 45°, 15° and 0° incidence angles. Ion yields for verapamil (see FIG. 3*a*) and substance p (see FIG. 4*a*) revealed a dramatic decrease in ion yield between 45° and 15° and close to zero signal at 0°. From the perspective of a simple illumination geometry argument, these results are counterintuitive because at 0° incidence angle the troughs between the columns are more exposed to the laser radiation than in the 45° case.

Conventional MALDI experiments were also conducted on the different facets of the probe using 2,5-dihydroxybenzoic acid (DHB) as the matrix. FIGS. 3*b* and 3*c* compare the MALDI mass spectra for incidence angles 45° and 0°, respectively. The essentially unaltered ion yields indicated that the dramatic decline in ion yields on LISMAs could not be explained away by the reduced ion collection efficiency in the source at 0°.

Laser surface processing of silicon at elevated fluences (e.g., ~0.8 J $cm^{-2}$) with plane polarized beams showed that p-polarized beams, with the electric field vector in the plane of incidence, were the most efficient in producing nanostructures.[12] The p-polarized beam seems to be absorbed more strongly by the perturbed silicon surface than its s-polarized counterpart with the electric field perpendicular to the plane of incidence.[13]

Figure 5:
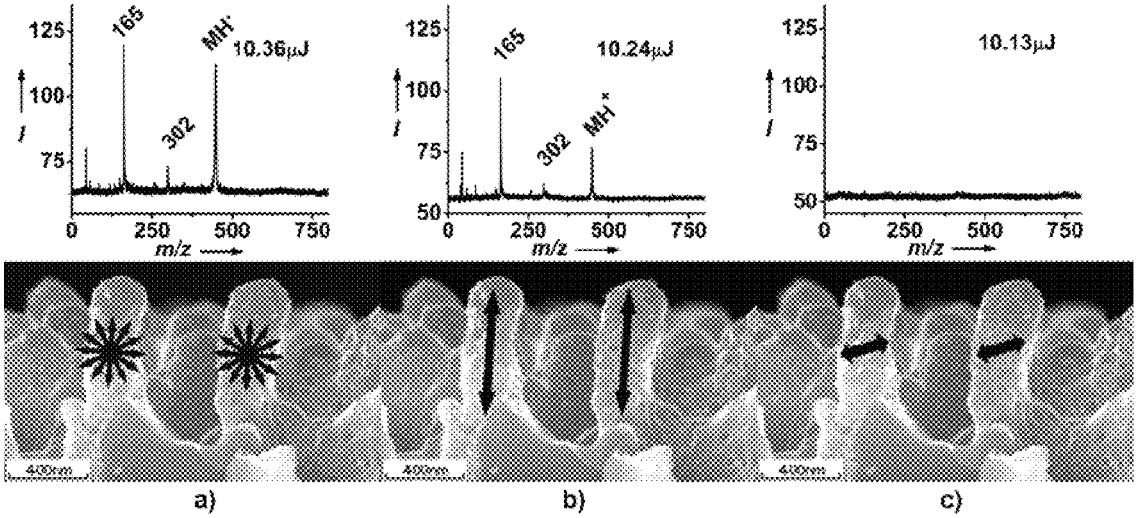
FIG. 5: Mass spectra of ion yields from LISMA were compared for laser desorption ionization experiments with a) unpolarized, b) p-polarized and c) s-polarized rays at ~10 μJ/pulse from a nitrogen laser. The p-polarized ray had similar ionization efficiency to the unpolarized ray, whereas no signal was detected with the s-polarized ray.
Figure 6:
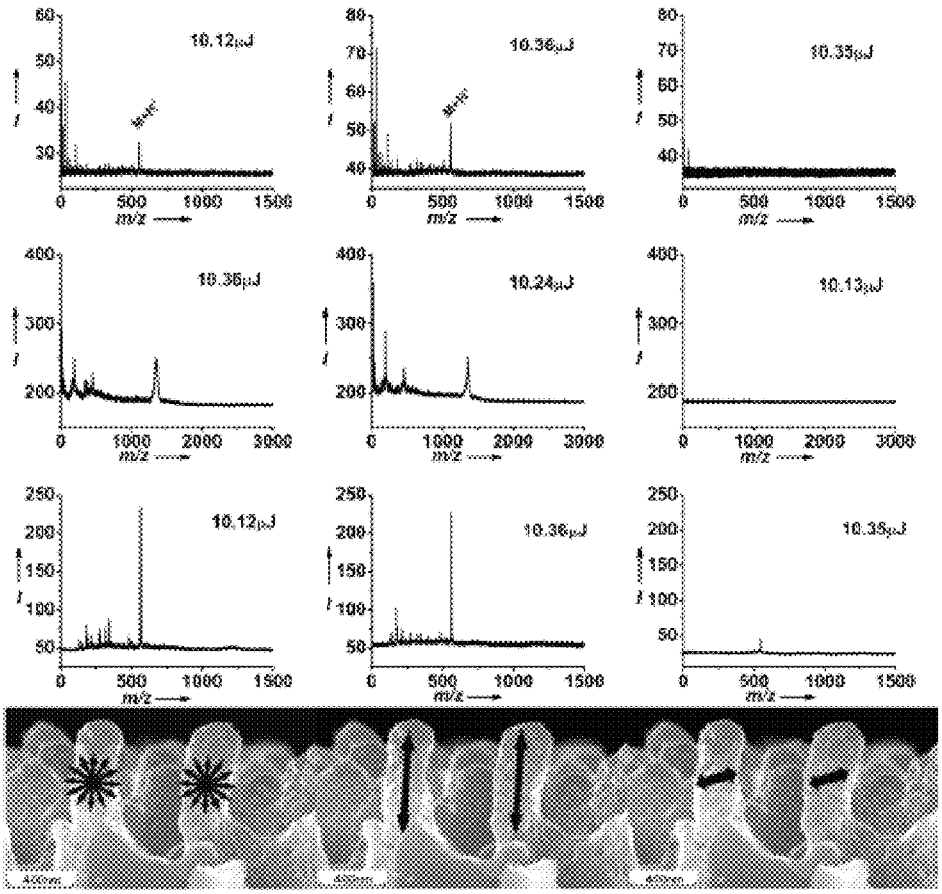
FIG. 6: Mass spectra of Reserpine (top row), substance P (second row), and leucine enkephalin (third row) from LISMA were compared for laser desorption ionization experiments with unpolarized a), p-polarized b) and s-polarized c) rays. The p-polarized beam had similar ionization efficiency to the unpolarized one, whereas no or marginal signal was detected with the s-polarized ray. All experiments were conducted with ~10 μJ laser pulse energies.

To explore the interaction of electromagnetic waves and LISMAs in desorption ionization experiments, a plane polarized laser beam was used at typical fluences (~0.1 J $cm^{-2}$) for ion production from adsorbates. By rotating the plane of polarization from p to s while maintaining the energy of the laser pulse at ~10 μJ, the ion yield from LISMAs showed a dramatic drop. FIG. 5 compares the laser desorption ionization spectra for verapamil with unpolarized, p-polarized and s-polarized beams. Compared to the unpolarized beam in FIG. 5*a*, when the LISMA was exposed to the p-polarized ray (see FIG. 5*b*), only a slight decrease in the signal was observed, whereas the s-polarized ray (see FIG. 5*c*) showed no signal at all. Similar results were obtained for other adsorbates such as small organics (reserpine) and peptides (leucine enkephalin and substance P), where marginal or no signal was observed for the s-polarized beam (see FIG. 6).

Figure 7:
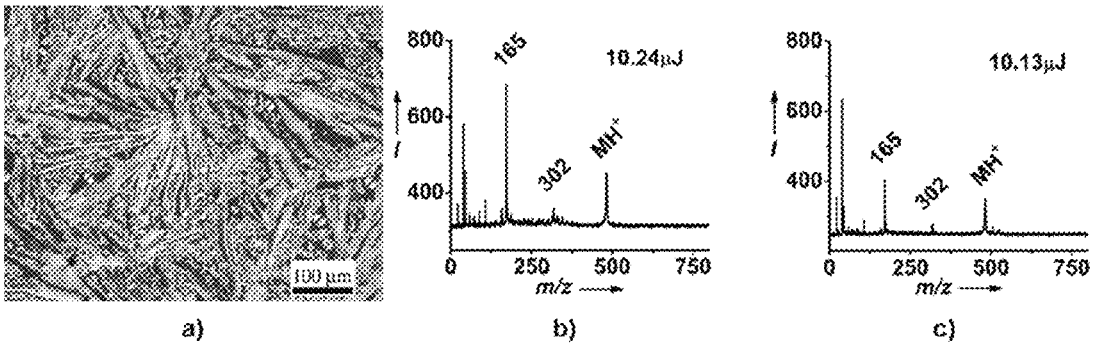
FIG. 7: a) Random orientation of matrix crystals is observed in the microscope image of the sample. MALDI mass spectra show no significant change between the b) p-polarized and the c) s-polarized rays.

In commonly used soft ionization methods, such as MALDI, polarization dependence of ion yields is not reported. As a control experiment, the MALDI ion yields of verapamil from DHB matrix with plane polarized laser beams were studied. FIG. 7 shows that no significant difference exists between the MALDI spectra using p-polarized and s-polarized rays (see FIGS. 7*b* and 7*c*, respectively). This finding can be rationalized by considering the random orientation of the matrix crystals (see FIG. 7*a*) in the polycrystalline sample.

Figure 8:
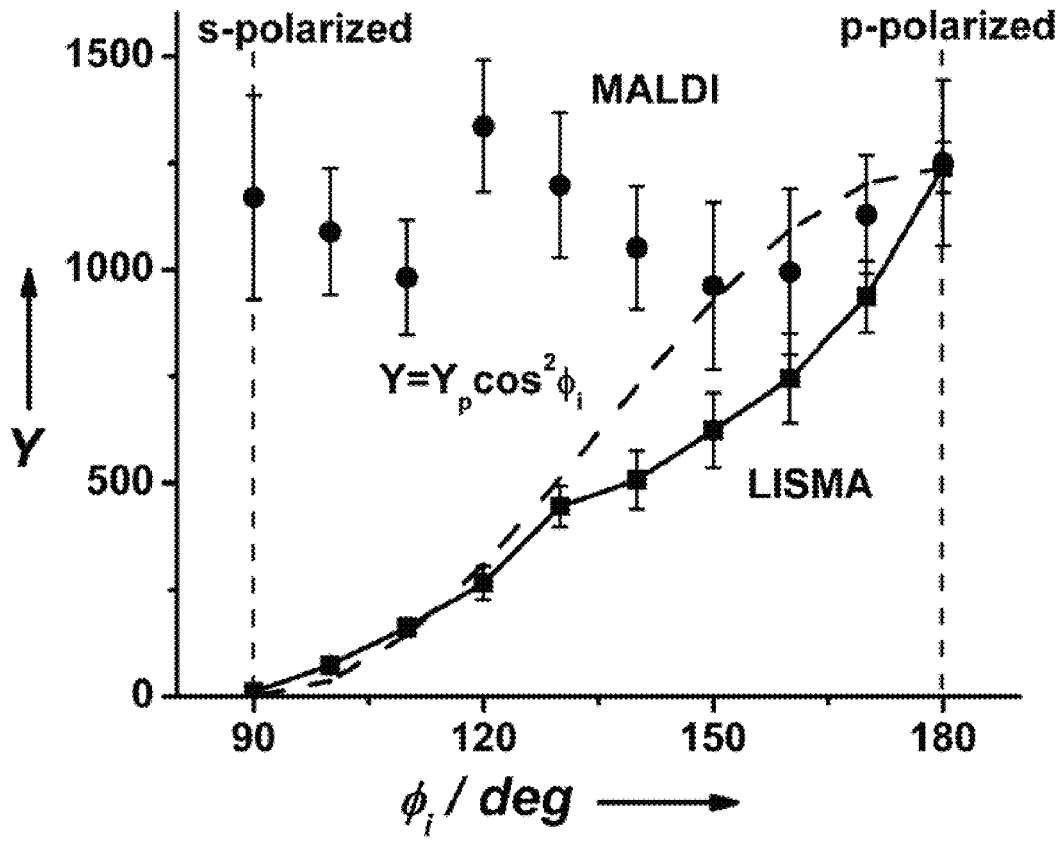
FIG. 8: Plots of total ion yields for leucine enkephalin show a comparison of LISMA (squares and solid line) and MALDI from DHB matrix (circles) as the plane of polarization was rotated from s-polarized to p-polarized while maintaining the pulse energies at ~10 μJ. Simple model prediction, analogous to Eq. (1), is shown by the dashed line.

To investigate the transition in ion production between the s- and p-polarized beams, the total ion yield, Y, for leucine enkephalin was recorded as a function of polarization angle, $\phi_i$, while maintaining a pulse energy of ~10 μJ (see FIG. 8). As a comparison the MALDI ion yield from DHB matrix was also recorded. For the LISMA platform ion production gradually diminished as the plane of polarization was rotated from parallel (p-polarized) to normal (s-polarized) to the plane of incidence, whereas no significant trend was observed for MALDI. Specifically, the LISMA ion yield for the p-polarized ray, $Y_p$, was ~110 times greater than that of the s-polarized ray, $Y_s$. When these experiments were performed going from the s- to the p-polarized beam, no hysteresis was observed in the ion yield curve. Similar results were obtained for small organics and peptides including reserpine, verapamil, and substance p.

The formation of LISMAs and other laser-induced periodic surface structures (LIPSS), e.g., gratings, demonstrate the resonant interactions of these modulated surfaces with laser radiation of commensurate wavelengths. At elevated fluences, for example between 0.4 and 0.8 J $cm^{-2}$ for 248 nm light impinging on silicon, the formation of these structures are promoted by the interference between the incident and the reflected, refracted or surface electromagnetic waves (SEW).[14] While below the melting temperature surface acoustic waves (SAW) are formed, with the appearance of a transient molten layer at elevated fluences laser modulated capillary waves (CW) dominate, whereas with the onset of rapid evaporation interference evaporation instabilities (IEI) become important.[15]

Similar to the evidence found for the formation of LIPSS, the observations on adsorbate ion yields at low fluences indicate a strong dependence on the angle of incidence (see FIG. 3) and on the polarization of the laser light (see FIG. 8). First it should be determined if energy deposition by the SEW can explain these observations. The amplitude of SEW is proportional to the projection of the incident wave electric field vector, $E_i$, on the substrate. If the desorption process was stimulated by the SEW that is resonant with the LISMA structure the observed angle dependence of the ion yield could be explained by the variation of the SEW intensity with the incidence angle. For p-polarized beam with $\theta_i$ angle of incidence, the substrate projection of the electric field vector is $E_{\parallel}=E_i \cos\theta_i$ predicting maximum SEW intensities for $\theta_i=0°$ with continuous decline as approaches 90°.[14,15] Thus energy deposition from SEW could not be the driving force behind laser desorption from LISMAs because the observed ion yields exhibited the opposite trend, i.e., they were zero at $\theta_i=0°$ and significantly increased as approached 45°.

For p-polarized incident laser beams, efficient LIPSS[14] and LISMA formation[16] were observed, whereas s-polarized radiation showed no or reduced surface structuring. Analogously, ion yields from adsorbates on LISMAs dramatically decreased when the incident beam polarization was changed from p to s.

A possible explanation of this difference can be based on the difference in laser-surface coupling for axial vs. transverse excitation of the columns. The height of the columns is ~2 times the 337 nm wavelength of the desorption laser. This structure and its electrostatic image in the "ground plane" of the bulk substrate would add to form an efficient antenna for p-polarized, but not s-polarized, light. The lateral dimension of the columns is about a wavelength but the image in the bulk would negate, rather than enhance, the laser-induced polarization. Furthermore, the lateral spacing of 500 nm is about 1.5 wavelengths, so the phase differences between columns lead to cancellation of induced polarization. It seems likely, therefore, that p-polarized laser light is significantly more efficiently absorbed by the columns than s-polarized. This will result in large temperature differences during the two types of laser pulses, which translate into differences in desorption efficiency and ion yield.

In a simple picture, the absorption efficiency depends on the projection of the electric field from a light wave polarized in the $\phi_i$ plane onto the microcolumns protruding perpendicular to the substrate, $E_{\perp}=E_i \sin\theta_i \cos\phi_i$. Thus the part of the laser intensity that is axially absorbed in the columns can be expressed as:

$$I_{\perp}=I_i \sin^2\theta_i \cos^2\phi_i, \quad (1)$$

where the incident light intensity is $I_i=c\epsilon_0 E_i^2/2$. The extrema of Eq. (1) are consistent with the experimental observations. For right angle illumination ($\theta_i=0°$) with light of any polarization, there is no axial absorption because $I_{\perp}(\theta_i=0)=0$. For a non-zero angle of incidence, e.g., $\theta_i=45°$, p-polarized beams with $\phi_i=180°$ result in maximum energy deposition, whereas for s-polarized radiation, $\phi_i=90°$ no axial modes are excited.

Thus energy deposition by axial absorption in the microcolumns is consistent with the low fluence ion yield data. The dashed line in FIG. 8, $Y=Y_p \cos^2 \cos\phi_i$, reflects the polarization angle dependence in Eq. (1). For $90° \leqq \phi_i \leqq 130°$ and for 180° the agreement with experimental data is excellent, whereas between 140° and 170° there is a considerable gap between the prediction by this simple model and the measured values. It is likely that in this polarization angle range additional factors, not incorporated into the present model, play a significant role. Importantly, above a threshold intensity the linear $I_i$ dependence in Eq. (1) prevails when the angle of incidence and polarization are kept constant (see FIG. 9).

Figure 9:
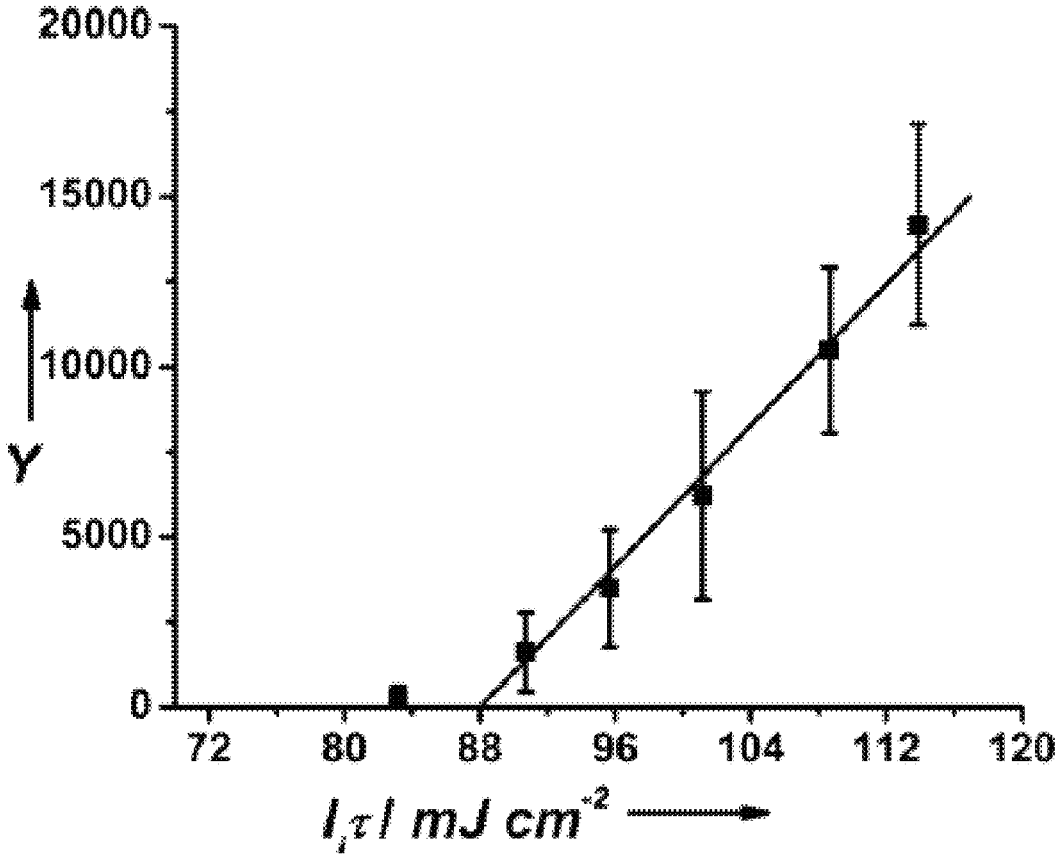
FIG. 9: Above a threshold, the photonic ion yield of verapamil from LISMA shows linear laser intensity, dependence. For constant angle of incidence and polarization this relationship is analogous to Eq. (1).

In MALDI experiments the ion yield as a function of incident laser intensity, $I_i$ shows threshold behavior followed by a strong non-linear response. FIG. 9 shows that ion production from LISMA also exhibits a threshold but, in the studied range, the intensity dependence appears to be linear. This is consistent with the assumption that the desorption and ionization processes are driven by the axially absorbed laser energy (see Eq. (1)), for constant angles of incidence and polarization.

Further testing of the hypothesis based on the role of axial absorption modes in laser desorption from LISMAs can be carried out by changing the aspect ratio, h/d, and the height-to-wavelength ratio, h/λ, of the microcolumns. If this hypothesis is correct as the aspect ratio approaches h/d<1, the influence of the angle of incidence and the polarization angle on the ion yield is expected to diminish. Similarly, the length of the columns in wavelength units, h/λ, will affect the efficiency of coupling the laser energy to the LISMA structure.

In the laser desorption of adsorbates, the aspect ratio of troughs, Wt, where t is the width of the troughs, impacts a different set of processes. The ability to retain residual solvents and large amounts of adsorbates increases with h/t. Nanoporous desorption substrates in desorption ionization on silicon (DIOS)[17] and in nanostructure-initiator mass spectrometry (NIMS)[18] are extreme examples of high trough aspect ratio structures. As the laser pulse produces a plume from these species, due to confinement effects, the plume density, persistence and chemistry are enhanced for high trough aspect ratios.[19]

The ion production properties on LISMAs described above represent the first example of nanophotonically modulated ion sources. Due to their structure, energy coupling between the LISMAs and the laser radiation is fundamentally different from MALDI, DIOS and NIMS. Thus, they enable the control of ion production by varying laser radiation properties other than simple pulse energy, in particular the angle of incidence and the plane of polarization. Photonic ion sources promise to enable enhanced control of ion production on a micro/nano scale and direct integration with microfluidic devices.

Experimental

Materials.

Low resistivity (0.001-0.005 Ωcm) p-type mechanical grade, 280±20 μm thick silicon wafers were purchased from University Wafer (South Boston, Mass.). HPLC grade substance P, leucine enkephalin, verapamil, and reserpine were purchased from Sigma Chemical Co. (St. Louis, Mo.).

LISMA Production.

Silicon wafers were cleaved into approximately 3×3 $mm^2$ chips and cleaned in deionized water and methanol baths. In a Petri dish the chips were submerged in deionized water and exposed to ~600 pulses from a mode-locked frequency-tripled Nd:YAG laser with 355-nm wavelength and 22-ps pulse length (PL2143, EKSPLA, Vilnius, Lithuania) operated at 2 Hz repetition rate. The laser was focused by a 25.4 cm effective focal length UV grade fused-silica lens (Thorlabs, Newton, N.J.) to create a 1 mm diameter spot and 0.13 J $cm^{-2}$ fluence.

Mass Spectrometry.

For the ion yield measurements the LISMA was attached to a solid insertion probe using double-sided conductive carbon tape. Subsequently, 1.5 μL of the ~$10^{-6}$ M aqueous analyte solution was deposited and air-dried on the LISMA surface. A home-built linear TOF-MS with τ=4-ns pulse length nitrogen laser (VSL-337ND, Laser Science Inc., Newton, Mass.) excitation at 337 nm was used for all desorption ionization experiments. A planoconvex focusing lens created a laser spot with a diameter of ~150 μm. In the MALDI experiments, the DHB and analyte were deposited onto a polished silicon wafer to provide a substrate material similar to the LISMA experiments. In all of the experiments, ion yields were based on the peak areas of the relevant ions.

Angle of Incidence Experiments.

Three different facets were machined on the cylindrical stainless steel probe tip to produce 0°, 15° and 45° angles of incidence. These facets accommodated the LISMA chips for the angle of incidence studies. By rotating a particular facet into the beam path, the ion yield for the corresponding angle could be determined.

Polarization experiments: The nitrogen laser beam was polarized by an uncoated Glan-Taylor calcite polarizer (GL10, Thorlabs, Newton, N.J.). In order to maintain a constant laser pulse energy of ~10 μJ, the polarized beam was attenuated using a continuously variable neutral density filter (NDC-50C-2M, Thorlabs, Newton, N.J.). The attenuated beam was focused onto the sample surface with a fused-silica lens (Thorlabs, Newton, N.J.).

Ion yield vs. incidence angle for substance P

To demonstrate the strong dependence of the ion yield on the incidence angle for larger biomolecules, the neuropeptide substance P was deposited onto the LISMA structure. While an abundant m/z 1347 molecular ion peak was observed for 45°, at 15° the signal was dramatically reduced, and at 0° it disappeared altogether (see panel (a) in FIG. 4). To verify that this effect was not a result of the varying ion collection efficiencies, MALDI experiments were performed with DHB matrix on the same facets of the probe. The resulting MALDI spectra for 0° and 45° incidence angles are shown in panels (b) and (c) of FIG. 4, respectively. It is clear from this data that, in contrast to the LISMA results, the MALDI signal does not show a significant dependence on the angle of incidence. These findings in combination with the data presented for verapamil (m/z 454) demonstrate that the strong dependence on the incidence angle of the desorption laser beam holds at higher molecular weights.

Polarization dependence for reserpine, leucine enkephalin and substance P

To see if the observed strong effect of the laser beam polarization on the ion yield was dependent on the nature or the molecular weight of the analyte, experiments were carried out with reserpine (m/z 609), substance P (m/z 1347) and leucine enkephalin (m/z 556). Whereas unpolarized and p-polarized laser pulses of approximately the same energy produced similar LISMA spectra with little change in molecular ion abundances, the s-polarized beam produced no spectra for reserpine and substance P and only marginal signal for leucine enkephalin (see FIG. 6).

Ion yield as a function of laser intensity

In MALDI experiments the ion yield as a function of incident laser intensity, $I_l$, shows threshold behavior followed by a strong non-linear response. FIG. 9 shows that ion production from LISMA also exhibits a threshold but, in the studied range, the intensity dependence appears to be linear. This is consistent with the assumption that the desorption and ionization processes are driven by the axially absorbed laser energy, as is expressed in Eq. (1) above, for constant angles of incidence and polarization.

Ion yield as a function of the deposited analye amount

Figure 10:
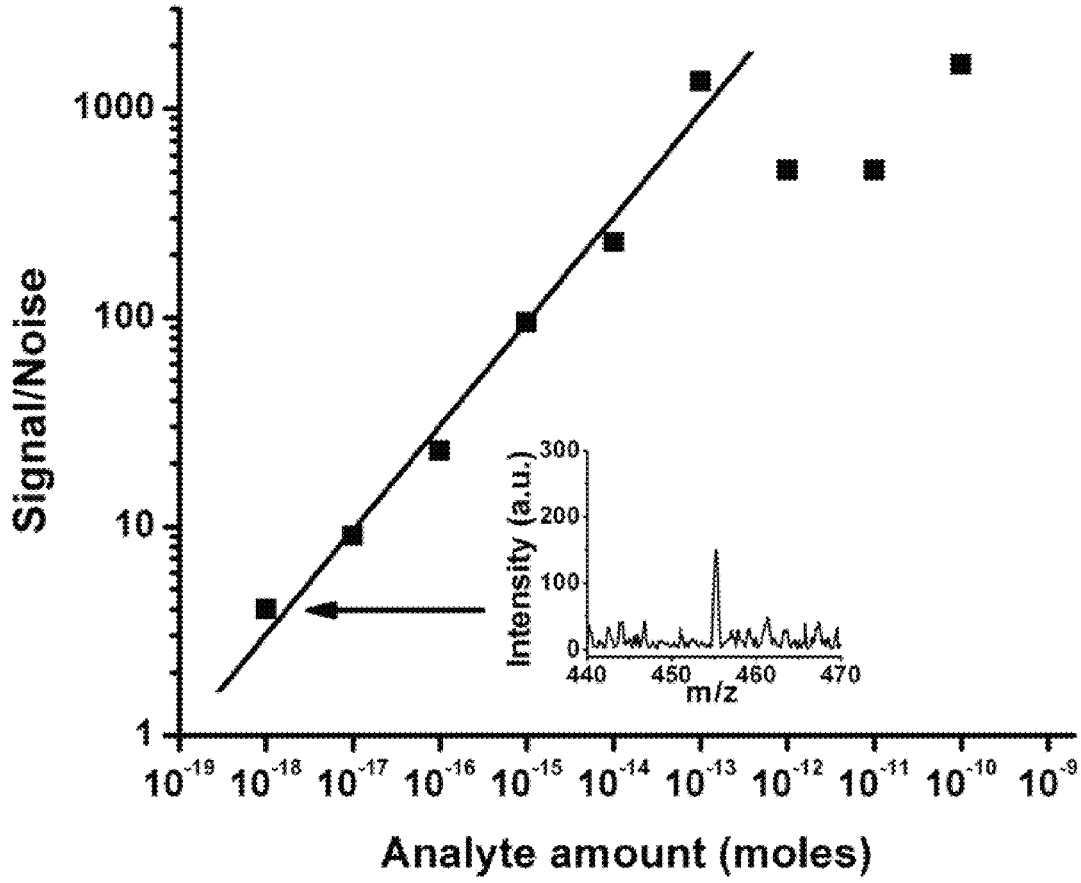
FIG. 10: Quantitation of verapamil analyte using LDI-MS from LISMA substrate shows low (1 attomole) limit of detection and wide (over 4 orders of magnitude) dynamic range. The inset shows the mass spectrum for 1 attomole verapamil.

Ion production from LISMA shows an ultralow limit of detection (e.g., 1 attomole for verapamil) and a wide dynamic range (see FIG. 10). In case of verapamil quantitation can be achieved for over 4 orders of magnitude. The inset shows the mass spectrum for 1 attomole verapamil.

REFERENCES

The following references are incorporated herein in their entirety as may be necessary to assist a person of ordinary skill in the art to fully understand the claimed invention.

[1] C. Girard, *Reports on Progress in Physics* 2005, 68, 1883.
[2] T. H. Taminiau, F. D. Stefani, F. B. Segerink, N. F. Van Hulst, *Nature Photonics* 2008, 2, 234.
[3] B. Schmidt, V. Almeida, C. Manolatou, S. Preble, M. Lipson, *Appl. Phys. Lett.* 2004, 85, 4854.
[4] P. Bhatnagar, S. S. Mark, I. Kim, H. Y. Chen, B. Schmidt, M. Lipson, C. A. Batt, *Adv. Mater.* 2006, 18, 315.
[5] S. Coyle, M. C. Netti, J. J. Baumberg, M. A. Ghanem, P. R. Birkin, P. N. Bartlett, D. M. Whittaker, *Phys. Rev. Lett.* 2001, 8717.
[6] T. H. Her, R. J. Finlay, C. Wu, S. Deliwala, E. Mazur, *Appl. Phys. Lett.* 1998, 73, 1673.
[7] C. H. Crouch, J. E. Carey, J. M. Warrender, M. J. Aziz, E. Mazur, F. Y. Genin, *Appl. Phys. Lett.* 2004, 84, 1850.
[8] V. Zorba, L. Persano, D. Pisignano, A. Athanassiou, E. Stratakis, R. Cingolani, P. Tzanetakis, C. Fotakis, *Nanotechnology* 2006, 17, 3234.
[9] Y. Chen, A. Vertes, *Anal. Chem.* 2006, 78, 5835.
[10] A. Westman, T. Huthfehre, P. Demirev, J. Bielawski, N. Medina, B. U. R. Sundqvist, *Rapid Commun. Mass Spectrom.* 1994, 8, 388.
[11] A. P. Quist, T. Huthfehre, B. U. R. Sundqvist, *Rapid Commun. Mass Spectrom.* 1994, 8, 149.
[12] A. J. Pedraza, J. D. Fowlkes, Y. F. Guan, *Appl. Phys., A* 2003, 77, 277.
[13] T. H. Her, R. J. Finlay, C. Wu, E. Mazur, *Appl. Phys., A* 2000, 70, 383.
[14] A. J. Pedraza, Y. F. Guan, J. D. Fowlkes, D. A. Smith, *J Vac. Sci. Technol., B* 2004, 22, 2823.
[15] S. A. Akhmanov, V. I. Emelyanov, N. I. Koroteyev, V. N. Seminogov, *Uspekhi Fizicheskikh Nauk* 1985, 147, 675.
[16] J. E. Carey, Ph. D. dissertation (*Harvard*) 2004.
[17] J. Wei, J. M. Buriak, G. Siuzdak, *Nature* 1999, 399, 243.
[18] T. R. Northen, O. Yanes, M. T. Northen, D. Marrinucci, W. Uritboonthai, J. Apon, S. L. Golledge, A. Nordstrom, G. Siuzdak, *Nature* 2007, 449, 1033.
[19] G. H. Luo, Y. Chen, G. Siuzdak, A. Vertes, *J. Phys. Chem., B* 2005, 109, 24450.
[20] Y. Chen, A. Vertes, *J Phys. Chem., A* 2003, 107, 9754.

What is claimed is:

1. A mass spectrometry system for controlling fragmentation and ion production from a sample, the system comprising:

a pulsed laser source;

a polarizer capable of plane polarizing radiation from the laser source and rotating the angle of plane polarized radiation from the laser source between an angle of s-polarized radiation and an angle of p-polarized radiation;

an array for receiving the sample, the array being made from a semiconductor material and having quasi-periodic columnar structures; and a mass spectrometer for detecting ions formed from the sample;

wherein when the radiation from the pulsed laser source is rotated so that when the angle of the plane polarization of the laser source approaches the angle of p-polarized radiation, the fragmentation and ion production from the sample is increased, and when the angle of the plane polarization of the laser source approaches the angle of s-polarized radiation, the fragmentation and ion production from the sample is decreased.

2. The system of claim 1, wherein the semiconductor material is selected from the group consisting of: p-type or n-type silicon, germanium and gallium arsenide at various doping levels.

3. The system of claim 1, wherein the array is a laser-induced silicon microcolumn array.

4. The system of claim 3, wherein the columnar structures have a height of about 1 to 5 times the wavelength of the radiation, a diameter equal to about one wavelength of the radiation, and a lateral periodicity of about 1.5 times the wavelength of the radiation.

5. The system of claim 3, wherein the columnar structures have a height of from about 200 nm to about 1500 nm, a diameter of from about 200 nm to about 400 nm, and a lateral periodicity of from about 450 nm to about 550 nm.

6. The system of claim 1, wherein the array is processed in an environment selected from the group consisting of: liquid water, sulfur hexafluoride, aqueous solutions, acids and bases.

7. The system of claim 1, wherein the array is processed in sodium hydroxide solution.

8. The system of claim 1, wherein the radiation is selected from the group consisting of: ultraviolet radiation, visible radiation and infrared radiation.

9. The system of claim 1, wherein the sample is selected from the group consisting of: pharmaceuticals, dyes, explosives or explosive residues, narcotics, polymers, tissue samples, individual cells, small cell populations, bacteria, viruses, fungi, biomolecules, chemical warfare agents and their signatures, peptides, metabolites, lipids, oligosaccharides, proteins and other biomolecules, synthetic organics, drugs, and toxic chemicals.

10. The system of claim 1, wherein the sample amount deposited on the LISMA can be determined by measuring the intensity of the related peak in the mass spectrum with a wide dynamic range and a low limit of detection.

11. The system of claim 10, wherein the dynamic range is greater than about 4 magnitude and wherein the limit of detection is about 1 attomole.

12. A method for controlling fragmentation and ion production from a sample during mass spectrometry analysis, the method comprising:

providing a sample;

providing a pulsed laser source;

providing a polarizer capable of plane polarizing radiation from the laser source and rotating the angle of plane polarized radiation from the laser source between an angle of s-polarized radiation and an angle of p-polarized radiation;

contacting the sample with an array made from a semiconductor material and having quasi-periodic columnar structures; and providing a mass spectrometer for detecting ions formed from the sample;

wherein when the radiation from the pulsed laser source is rotated so that when the angle of the plane polarization of the laser source approaches the angle of p-polarized radiation, the fragmentation and ion production detected by the mass spectrometer is increased, and when the angle of the plane polarization of the laser source approaches the angle of s-polarized radiation, the fragmentation and ion production detected by the mass spectrometer is decreased.

13. The method of claim 12, wherein the semiconductor material is selected from the group consisting of: p-type or n-type silicon, germanium and gallium arsenide at various doping levels.

14. The method of claim 12, wherein the array is a laser-induced silicon microcolumn array.

15. The method of claim 14, wherein the columnar structures have a height of about 1 to 5 times the wavelength of the radiation, a diameter equal to about one wavelength of the radiation, and a lateral periodicity of about 1.5 times the wavelength of the radiation.

16. The method of claim 14, wherein the columnar structures have a height of from about 200 nm to about 1500 nm, a diameter of from about 200 nm to about 400 nm, and a lateral periodicity of from about 450 nm to about 550 nm.

17. The method of claim 12, wherein the array is processed in an environment selected from the group consisting of: liquid water, sulfur hexafluoride, aqueous solutions, acids and bases.

18. The method of claim 12, wherein the array is processed in sodium hydroxide solution.

19. The method of claim 12, wherein the radiation is selected from the group consisting of: ultraviolet radiation, visible radiation and infrared radiation.

20. The method of claim 12, wherein the sample is selected from the group consisting of: pharmaceuticals, dyes, explosives or explosive residues, narcotics, polymers, tissue samples, individual cells, small cell populations, bacteria, viruses, fungi, biomolecules, chemical warfare agents and their signatures, peptides, metabolites, lipids, oligosaccharides, proteins and other biomolecules, synthetic organics, drugs, and toxic chemicals.

21. The method of claim 12, wherein the sample amount deposited on the LISMA can be determined by measuring the intensity of the related peak in the mass spectrum with a wide dynamic range and a low limit of detection.

22. The method of claim 21, wherein the dynamic range is greater than about 4 magnitude and the limit of detection is about 1 attomole.

* * * * *